US008193514B2

(12) United States Patent
Ferraro et al.

(10) Patent No.: US 8,193,514 B2
(45) Date of Patent: Jun. 5, 2012

(54) APPARATUS AND METHOD FOR CURING SURFACE COATED MATERIALS

(75) Inventors: Tony Ferraro, Mississauga (CA); Leslie Pawlowski, Fenwick (CA); Andrew Stanislaw Chochol, Alliston (CA)

(73) Assignee: UView Ultraviolet Systems, Inc., Mississauga, Ontario (CA)

( * ) Notice: Subject to any disclaimer, the term of this patent is extended or adjusted under 35 U.S.C. 154(b) by 866 days.

(21) Appl. No.: 11/718,374

(22) PCT Filed: Nov. 1, 2005

(86) PCT No.: PCT/CA2005/001670

§ 371 (c)(1),
(2), (4) Date: Nov. 21, 2008

(87) PCT Pub. No.: WO2006/047866

PCT Pub. Date: May 11, 2006

(65) Prior Publication Data

US 2009/0130328 A1 May 21, 2009

Related U.S. Application Data

(60) Provisional application No. 60/624,241, filed on Nov. 1, 2004.

(51) Int. Cl.
*G21G 5/00* (2006.01)

(52) U.S. Cl. ..... 250/455.11; 250/453.11; 250/454.11; 250/504 R

(58) Field of Classification Search ..... . 250/453.11–455.11, 504 R
See application file for complete search history.

(56) References Cited

U.S. PATENT DOCUMENTS 3,930,318 A 1/1976 Stelter et al.
(Continued)

FOREIGN PATENT DOCUMENTS

JP 4045864 2/1992
(Continued)

OTHER PUBLICATIONS

Spot Quick Drying System datasheet, Fillon Technologies, http://www.fillon-technologies.com/lespays/FichesTech/pdf/spot.pdf, 2 pages, prior to May 2007.

(Continued)

*Primary Examiner* — Michael Maskell
(74) *Attorney, Agent, or Firm* — K&L Gates LLP

(57) ABSTRACT

The invention is directed to an apparatus and methods for curing a surface that is coated with a curable resin, such as an ultraviolet light-curable surface coating. The method involves directing radiation to the curable coating material using an apparatus of the invention to form a cured surface without substantially increasing the temperature of the work surface. The surface coating material can contain ultraviolet reactive photo-initiator compounds. An apparatus for curing a surface coating material is also provided. In one embodiment the apparatus includes a source of ultraviolet radiation that emits radiation having wavelengths in the range of about 315 to about 400 nm, an air cooling system that maintains an optimum temperature that maximizes the ultraviolet energy output and vents exhaust air away from the targeted work surface, and a positioning panel that holds the ultraviolet light source and allows the ultraviolet radiation source to be rotated both in the horizontal and vertical directions such that the apparatus can be accurately directed towards the target surface coating material.

21 Claims, 6 Drawing Sheets

U.S. PATENT DOCUMENTS

| | | | | |
|---|---|---|---|---|
| 4,019,062 | A | 4/1977 | Rongren | |
| 4,025,795 | A | 5/1977 | Lackore et al. | |
| 4,037,329 | A | 7/1977 | Wallace | |
| 4,298,806 | A | 11/1981 | Herold | |
| 4,309,617 | A * | 1/1982 | Long | 250/504 H |
| 4,516,195 | A * | 5/1985 | Gonser | 362/281 |
| 4,634,562 | A * | 1/1987 | Downey | 264/488 |
| 4,839,522 | A | 6/1989 | Bourgeois et al. | |
| 4,864,145 | A * | 9/1989 | Burgio, Jr. | 250/492.1 |
| 5,426,308 | A * | 6/1995 | Sudduth et al. | 250/504 H |
| 5,521,392 | A * | 5/1996 | Kennedy et al. | 250/492.1 |
| 5,788,364 | A | 8/1998 | Cooper et al. | |
| 6,000,815 | A * | 12/1999 | Jennings | 362/285 |
| 6,207,118 | B1 * | 3/2001 | Gaven et al. | 422/186.3 |
| 6,271,532 | B1 | 8/2001 | Trokhan et al. | |
| 6,520,663 | B1 * | 2/2003 | Holmes et al. | 362/285 |
| 6,573,665 | B2 | 6/2003 | Cooper et al. | |
| 6,617,589 | B2 * | 9/2003 | Ueno | 250/455.11 |
| 2002/0047546 | A1 * | 4/2002 | Kayser | 315/117 |
| 2002/0188218 | A1 * | 12/2002 | Lipman | 600/557 |
| 2002/0190225 | A1 * | 12/2002 | Burgio | 250/492.1 |
| 2004/0084639 | A1 * | 5/2004 | Guzorek | 250/504 R |
| 2005/0116178 | A1 * | 6/2005 | Aguirre et al. | 250/492.1 |
| 2005/0116179 | A1 * | 6/2005 | Aguirre et al. | 250/492.1 |
| 2006/0273265 | A1 * | 12/2006 | Lipson | 250/493.1 |

FOREIGN PATENT DOCUMENTS

| | | |
|---|---|---|
| WO | 9739880 | 10/1997 |
| WO | 0204214 | 1/2002 |
| WO | 0218116 | 7/2002 |

OTHER PUBLICATIONS

Krono-Quick Drying System, http://www.fillontechnologies.com/lespays/FichesTech/pdf/krono.pdf, 2 pages, prior to May 2007.

Porta-Ray 400 Portable UV Curing System datasheet, http://www.uvitron.com/PDF%20Files/PortaRay400%20RevC.pdf, 1 page, prior to May 2007.

Intelli-ray 400 Watt UV Flood UV Curing System datasheet, http://www.uvitron.com/Literature.html, 2 pages, prior to May 2007.

Labino AB Brochure: The Labino Compact UV Lamps 12-24VDC, Model 135, 135 H, PH 135, http://www.labino.se/dealer/index2.html, 2 pages, prior to May 2007.

Spectroline ML3500C Brochure: Spectronics Corporation, http://www.spectroline.com/uv_curing_lamps_html, 3 pages, prior to May 2007.

Leading by Arc Lengths: UV Lamps from Honle, Honle UV Technology, 2 pages, 2002.

Solutions at the Speed of Light, Ultra Violet Systems, 2 pages, 2007.

UV 900 Curing System Brochure: Dedoes Direct, 1 page, prior to May 2007.

UV 255 Curing System Brochure: Dedoes Direct, 1 page, prior to May 2007.

Heat Lamps Brochure dated Nov. 2003, 1 page.

* cited by examiner

APPARATUS AND METHOD FOR CURING SURFACE COATED MATERIALS

BACKGROUND OF THE INVENTION

A surface coating is generally applied to a damaged portion of a vehicle, to return the surface of the vehicle to its prior undamaged appearance. To repair the damaged portion of a vehicle panel, a combination of mechanical forming putties, fillers, primers, paints and topcoats are typically used. Many of these materials are dissolved in solvent based carriers and require significant amounts of time for solvent evaporation and resin curing. Attempts have been made to accelerate this process using heat or infrared irradiating devices in baking tunnels or chambers.

Heat-based curing methods have disadvantages in that they require time before an appropriate curing temperature is reached and once that temperature is reached, the heat or infrared energy is not localized to the region where curing takes place. This leads to heating of areas surrounding the intended curing region. Once curing is completed, both the surface coating and surrounding area must be cooled before the repair can be continued. Both the heating and cooling processes extend the amount of time required to complete a given repair.

New compositions and methods for curing surface coatings are needed that are faster and easier to employ. Such methods can be used to improve the efficiency and speed with which a repair operation can be completed.

SUMMARY OF THE INVENTION

Compositions and methods for curing a surface that is coated with a curable resin are disclosed. In one embodiment, the apparatus includes an electromagnetic radiation source adapted to cure a curable resin, a cooling system that maintains an optimum temperature that optimizes energy output of the radiation source and vents exhaust air away from the target surface, a positioning panel that holds the electromagnetic radiation source and cooling system and allows the electromagnetic radiation source to be rotated both in the horizontal and vertical directions such that the apparatus can be accurately directed towards the target surface. The invention can include a ballast that provides proper starting and operating electrical conditions for powering the electromagnetic radiation source.

In an embodiment, an ultraviolet radiation source can be included in the disclosed device. The ultraviolet radiation source can include at least one fluorescent bulb.

In an embodiment, the power of the ballast can be greater than or equal to the power required to drive the radiation source. In more preferred embodiments, the power of the ballast is greater than the power required to drive the radiation source.

In an embodiment, an infrared radiation source can be included in the device. Certain embodiments can also include an ultraviolet radiation source and an infrared light source.

In an embodiment, a cooling system can be included in the disclosed device. The cooling system can include a variable speed fan. The fan can be controlled such that its speed depends, in part, on the relative proportion of ultraviolet light and infrared light emitted by the apparatus alternatively the fan can be controlled by the temperature inside the positioning panel. The cooling system can be configured to vent exhaust air away from the target work surface to assist in maintaining a clean surface. In alternate embodiments, pressurized or compressed air can be used to cool the radiation source.

In an embodiment, a heat sensor can be included in the device. The heat sensor can be configured to shut off the light source when the heat passes a predetermined threshold temperature. The heat sensor can be configured to measure the temperature of the radiation source, the internal confines of the panel, the curing surface or other area in the vicinity of the positioning panel, as desired.

In an embodiment, a positioning panel can be included in the device. The positioning panel can hold a radiation source and a cooling system. The positioning panel can be adapted to provide rotation of the radiation source in both the horizontal and vertical direction such that radiation can be accurately directed towards the target work surface.

In an embodiment, the ultraviolet radiation source can include a fluorescent light or a plurality of fluorescent lights which can be arranged in the positioning panel. The ultraviolet radiation source can also be a light emitting diode or at least one laser.

In an embodiment, a positioning panel having a reflector can be included in the device. The reflector can be positioned such that radiation can be reflected in the direction of the target work surface.

In an embodiment, a timer for timing a curing treatment can be included in the device.

In an embodiment, a visual reference aid for visually assisting in the positioning of the positioning panel can be included in the device.

In an embodiment, a counter for measuring the operational life of the ultraviolet light source can be included in the device.

In an embodiment, a radiometer for measuring the amount of ultraviolet light transmitted to a work surface can be included in the device.

In an embodiment, the device can include a distance sensing device for measuring the distance of a positioning panel from a work surface. The apparatus can also include an alarm to alert an operator that the positioning panel is positioned at an inappropriate distance from a work surface.

Methods for curing a surface that is coated with an ultraviolet light-curable surface coating are also disclosed. To this end, the surface coating material can contain a polymeric resin containing an ultraviolet reactive photo-initiator compounds that are suitable for initiating curing or crosslinking of the resin polymer molecules. The method can include the step of obtaining a radiation source suitable for curing and directing radiation from the source onto the surface coating using a curing apparatus of the invention to form the cured surface. It is desirable that the temperature of the curing surface remain substantially near ambient temperatures. Thus, temperature increases of about 20° C. or less at the work surface are preferred, more preferably temperature increases of about 10° C. or less are preferred, more preferably temperature increases will be about 5° C. or less, still more preferably the temperature increases are less than about 3, 2 or even 1° C. or less.

A method is disclosed for repairing a surface wherein a surface coating material containing an ultraviolet reactive photo-initiator compound is obtained. The coating material can be applied to a surface in need of repair. An ultraviolet radiation source can be obtained and ultraviolet radiation can be directed onto the surface coating material to form a cured surface coating while maintaining the temperature of the surface at substantially ambient temperature.

Additional features and advantages of the invention are described in, and will be apparent from, the following Detailed Description of the Invention and the Figures.

DETAILED DESCRIPTION OF THE INVENTION

Figure 1:
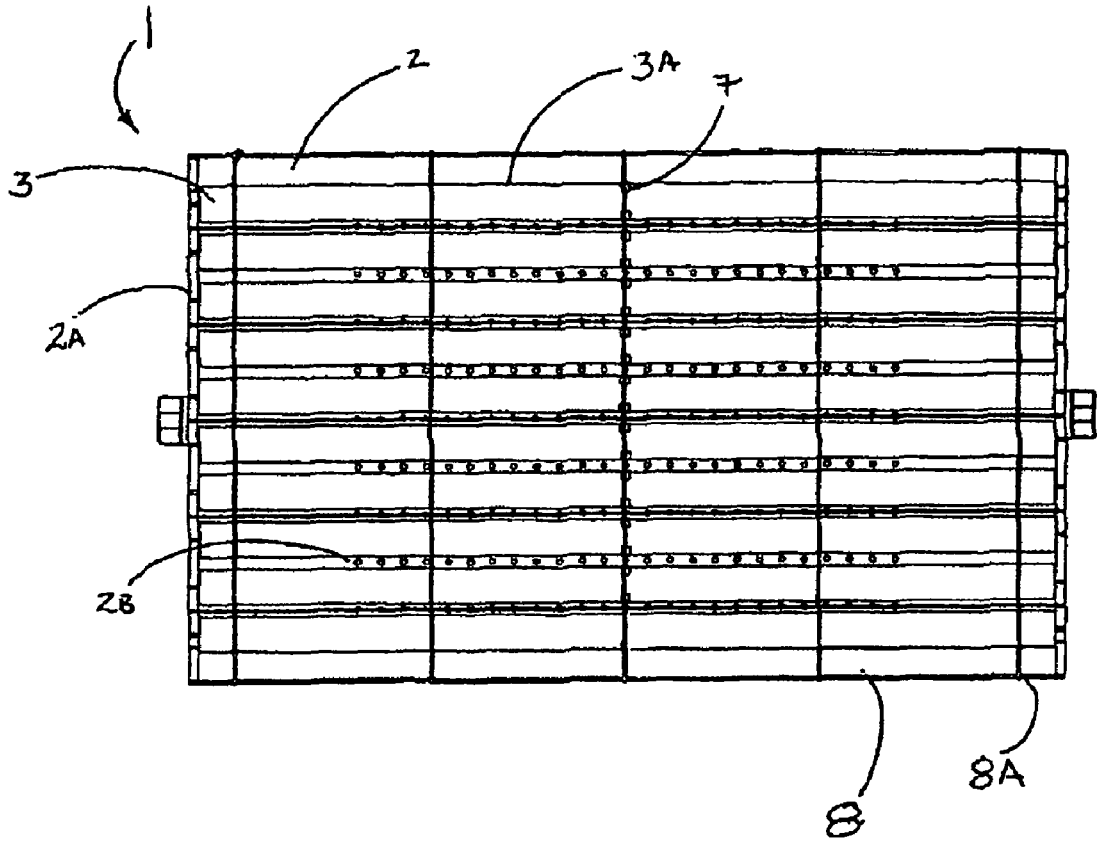
FIG. 1 provides a front elevation view of one version of the positioning panel of the curing apparatus.

An apparatus for use in curing surfaces coated with curable resins is disclosed. The apparatus emits radiation that assists in the curing process. Depending upon the wavelength of radiation emitted by the apparatus, curing can occur with minimal heating of the curing surface. This can improve the speed of repair procedures which do not require the repair technician to wait for the surface to cool down after curing. The apparatus can be used with ultraviolet curing resins that have exceptionally quick curing properties and that contain low quantities of volatile organic compounds (VOCs). Because they have low quantities of volatile organic compounds, such materials require minimal drying/evaporation time. Alternatively, the apparatus can also be used with traditional curing resins, which can be cured by either ultraviolet or infrared radiation.

In an embodiment, the apparatus can include a radiation source suitable for curing a curable resin, a cooling system that can maintain an optimum temperature for maximizing the energy output and venting exhaust air away from the target surface, a positioning panel for holding the radiation source and cooling system. The positioning panel can be rotated both in the horizontal and vertical directions such that the radiation can be accurately and uniformly directed towards the target surface. The apparatus can include a ballast that provides proper starting and operating electrical conditions for the radiation source.

The radiation source can be a fluorescent light or a plurality of fluorescent lights which can be arranged in the positioning panel. Such a source can be used to emit a broad wavelength range of light, including ultraviolet light. The ultraviolet radiation source can also be at least one light emitting diode or at least one laser. In addition to fluorescent lamps, suitable ultraviolet emission sources include LEDs, electron beams, lasers, and the like so long as radiation of a suitable wavelength and intensity for curing the resin is emitted. The curing apparatus of the present method can employ a plurality of fluorescent tubes mounted to a positioning panel that can be directed towards the targeted work surface. By providing a plurality of radiation sources, a greater area of repair can be achieved in a single curing operation. The positioning panel can have an area greater than one square foot, more preferably the positioning panel has an area greater than two square feet, still more preferably the positioning panel has an area greater than three square feet. The upper size limit for the positioning panel is only limited by the capacity of the stand used to support it.

In an embodiment, the radiation source is an ultraviolet radiation source. When the apparatus emits ultraviolet radiation, UVA radiation is preferred. Such radiation will typically have a wavelength ranging from about 315 nanometers to about 400 nanometers. The use of UVA radiation is preferred because it is safer for the operator and other bystanders within the operating field than UVB and UVC emitting devices.

In embodiments that utilize tube lights, the tubes can be of any suitable length which includes any lengths that can be conveniently fit into a positioning panel. For example, lengths for positioning panel bulbs can be industry standard lengths, including about 21, 32, 36, 46, 48, 58, 72, 84, or 96 inches but other lengths such as about 19, 30, 34, 44, 46, 56, 70, 82, or 94 inches can be used. As can be appreciated, the invention allows for the use of any bulb length. In addition, the radiation source can be a laser, LED, halogen lamp, or other light source.

In an embodiment, fluorescent lamps of the apparatus can have an optimum temperature at which ultraviolet energy output is maximal. To maintain this temperature, air can be drawn over the surfaces of the lamp to provide cooling. In an embodiment, cooling air can be drawn up from the work surface into the positioning panel where it contacts a lamp. A blower, fan or pressurized air can be used for this purpose. Preferably, the air is exhausted away from the work surface, for example out the back of the positioning panel. Particles or dust in the surrounding air, can also be drawn into the apparatus by means of this airflow and away from the targeted work surface. This keeps dust or deposits from contacting the work surface and the surface coating material before and during the curing process. Such dust can lead to inferior quality work or can require the work to be repeated. The airflow through the apparatus ensures that the apparatus can be positioned close to the work surface without disturbing or depositing dust or particles on the surface under repair and helps to ensure that the apparatus and bulbs will not overheat.

In an embodiment, the power of the ballast can be greater than or equal to the power of the bulb it powers. For example, a 90 Watt fluorescent bulb could be used with a 100 Watt ballast. The invention is not limited to any particular difference between bulb and ballast power. The difference between bulb and ballast power could be about 10, 20, 30, or 40 percent or more, for example.

Methods for curing apparatus with an infrared light source are also disclosed. One of skill can appreciate that infrared radiation will typically have wavelength maxima ranging from about 700 nm to about 1 mm. Infrared radiation produces more heat than ultraviolet radiation, making it preferred for certain resins that can not include ultraviolet photoinitiators. Certain embodiments of the invention can include a ultraviolet radiation source and an infrared light source. When ultraviolet radiation sources and infrared radiation sources are both found in the positioning panel, they can be configured such that they are evenly distributed over the target work site and not concentrated disproportionate to the other in a particular area.

In an embodiment, the cooling system can include a variable speed fan, which can have an optimum speed. The fan speed can be made to depend upon the relative proportion of ultraviolet light or infrared light emitted by the apparatus, and the temperature resulting from such radiation. The speed of the fan can be adjusted to maintain the temperature in or near the positioning panel in a desired range.

The device can include a heat or temperature sensor adapted to shut off the light source when the temperature passes a predetermined threshold value. The heat sensor can also be used to regulate the fan speed such that the fan speed can be increased if the lamps are too hot or decreased if the lamps are too cold.

The device can include a positioning panel which can be connected to a mobile support stand for ease of adjustment by the operator. The positioning panel can hold a radiation source and a cooling system. The positioning panel can be adapted to allow the radiation source to be rotated both in the horizontal and vertical directions such that the emitted radiation can be accurately directed towards the target work surface with the result that the time required for curing can be minimized.

The positioning panel can allow ultraviolet radiation devices of the invention to be accurately directed towards the work surface to maximize the exposure of the repair surface to the radiation. Positioning mechanisms can be included in the apparatus that allow the positioning panel to be lifted or rotated both in the horizontal and vertical directions, as needed. The support arm can be connected to a mobile support stand, for ease of adjustment by the operator. This configuration provides for accurately locating the ultraviolet device so that the duration required for curing can be minimized.

In an embodiment, the positioning panel can include a reflector for directing radiation toward the work surface. The reflector can be incorporated into the light bulbs or can be included as a component of the positioning panel.

The positioning panel can include a fan for cooling the ultraviolet radiation source. In certain of these embodiments the fan circulates air from the front of the positioning panel facing the work surface to the back of the positioning panel away from the work surface. Alternatively, the cooling source can be provided by heat exchanging devices, by compressed gases, liquids or other methods.

To operate the apparatus, a timer mechanism can be activated and the time required for curing the particular surface coating material set. The location and distance of the positioning panel from the curing material can also be set. Then upon completion of curing, the timer deactivates the radiation source and the operator can continue with repair of the surface.

Because ultraviolet radiation can be difficult to detect or is invisible to the human eye, in certain embodiments, a visual reference can be used to aid in properly positioning the positioning panel with respect to the targeted work surface. Any suitable visual reference can be used, for example visible electron beams or lights. In such a configuration, the device can project a visible reference onto the targeted work surface indicating the perimeter of the radiation upon the work surface. Using this system an operator can more accurately and efficiently position the positioning panel and ensure the targeted work area is contained within the radiation field of apparatus.

The apparatus can have a measurement device, such as a mechanical or electronic counter, that keeps track of the duration that the light source has operated. Over the life span of the radiation source, the power output can slowly deteriorate. A timer can be used to record this usage and let the operator know when the radiation source should be replaced.

The apparatus can also be equipped with a sensor, such as a radiometer, that can measure the quantity of radiation transmitted to the work surface and adjusts the amount of curing by decreasing or increasing the length of the operating cycle to ensure sufficient but not excessive curing of the coating material. Such a sensor can be used to maintain the quantity radiation transmitted to the work surface to predetermined amounts.

The apparatus can be equipped with a distance-sensing device that can warn the operator that the radiation source and positioning panel are located improperly. A visual and/or audible indicator can be used to warn the operator that the apparatus is located at an inadequate distance for curing and that the operator should reposition the device. This can help to avoid insufficient curing and avoids the need for supplementary curing processes.

Methods for repairing or modifying a surface are also disclosed. To this end a surface coating material whose curing can be assisted by the application of radiation, can be applied to a surface, such as a targeted vehicle or vehicle panel. For ultraviolet curable resins, the coating can contain ultraviolet sensitive photo-initiators such that when exposed to sufficient amounts of ultraviolet radiation, a chemical reaction occurs that causes the polymers to crosslink and form a solid three-dimensional network. The result, desirably, is a durable surface coating that is cured or polymerized.

The method involves obtaining a suitable radiation source and directing the radiation from the source onto the surface coating and curing the coating to form a hard surface. This is most conveniently accomplished using the curing apparatus of the invention. Preferably, surface temperatures remain at a temperature that is substantially at ambient temperature. For example, temperature increases of about 20° C. or less are preferred, more preferably increases of about 10° C. or less are preferred, still more preferably an increase of about 5° C. or less, still more preferably the temperature increases will be about 3, 2 or 1° C. or less.

Certain embodiments of the disclosed apparatus can be better understood by referring to FIGS. 1-7.

Figure 2:
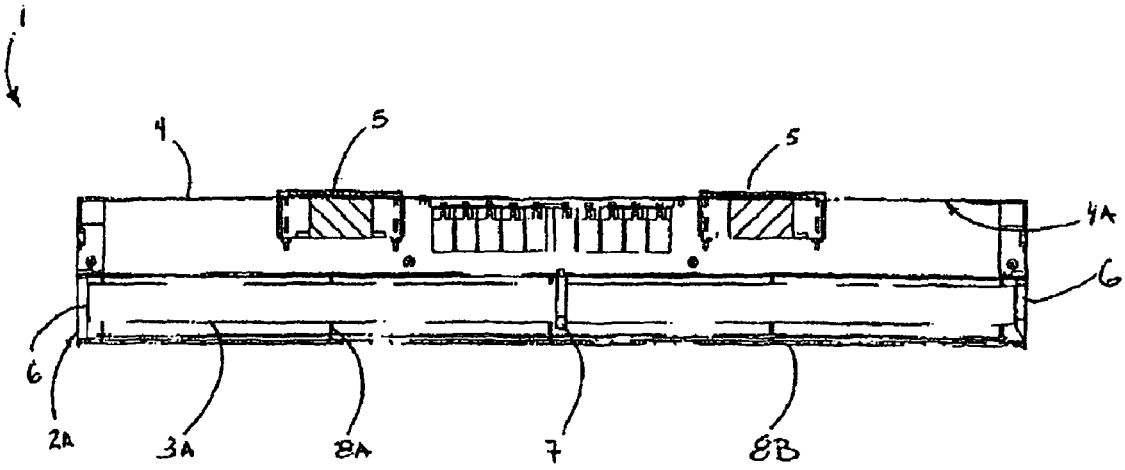
FIG. 2 provides a side view of one version of the positioning panel of the curing apparatus.

Referring to FIGS. 1 and 2 an embodiment of the positioning panel 1 is illustrated wherein the positioning panel 1 includes a positioning panel body 2, a radiation source 3, a support box 4, an array of blowers 5 and a protective cage 8. Radiation source 3 is positioned on positioning panel body 2 to project radiation towards a work surface. Support box 4 is positioned on positioning panel body 2, on the opposite side of radiation source 3. The blowers 5 draw the air over the radiation source 3 providing a cooling effect through positioning panel body 1, hereinafter referred to as the lamp head. Protective cage 8 surrounds radiation source 3 and positioning panel body 2, and prevents damage to the radiation source 3.

Positioning panel body 2 of FIG. 2 has a flat rectilinear surface with sidewalls on two edges 2A perpendicular to the flat surface. The sidewalls protrude towards the work surface to protect radiation source 3 along these edges. Two sidewall sections 2A on the positioning panel are located on opposing ends of positioning panel body 2. Positioning panel body 2 provides a reflective effect re-directing any radiation towards the work surface. Further, positioning panel body 2, has an array of air holes 2B to allow for the blowers 5 to direct the air trough the panel and into the support box 4.

Radiation source 3, can be a plurality of fluorescent tubes 3A producing an instantaneous ultraviolet lighting type having a spectral range comparable to that of UVA radiation, from about 315 nm to about 400 nm. The spectral peak of the ultraviolet radiation can be varied as necessary depending upon the surface coating material to be cured and its ultraviolet reactive photo-initiator. For example, radiation source 3 can use tubes 3A that can produce infrared radiation.

Radiation source tubes 3A can be arranged parallel to each other in a plane that is offset from the positioning panel body 2. Preferably, the tubes are spaced at equal distances to provide an equal distribution of projected radiation. Radiation source 3A can be connected to positioning panel body 2 by lamp-retaining sockets. For each fluorescent tube there can be a lamp-retaining socket at each end of the tube, providing the electrical connection to the bulb. In addition to the lamp-retaining sockets, positioning panels can include a tube spring clip 7 for supporting the tube. The number, type and arrangement of the radiation device's components can be varied as desired or needed to suit particular curing application.

As further illustrated in FIG. 1, a protective cage can surround positioning panel body 2 and lamp 3. Protective cage 8 extends to the perimeter edges of the position panel body 2 and can provide protection to positioning panel body 2 and lamp 3. Protective cage 8 can prevent fragments of lamp 3 from scattering beyond the lamp head 1 in the event the lamp 3 is damaged or broken. Cage 8 can be offset from positioning panel body 2 and situated beyond lamp 3, as illustrated. Cage 8 can be constructed of a cage frame 8A and an ultraviolet transmissible barrier 8B. In an embodiment ultraviolet transmissible barrier 8B can be constructed as a lattice or a planar material that permits ultraviolet energy to be conveyed from the lamp 3 to the targeted work surface. Cage frame 8A supports ultraviolet transmissible barrier 8B on positioning panel body 2. Cage frame 8A contains an array of air holes 8C to allow air to be drawn into the positioning panel 2. In addition, there can be air holes 8C located in ultraviolet transmissible barrier 8B.

Ultraviolet transmissible barrier 8B can be a high ultraviolet transmittance transparent plastic sheet. Alternatively, the ultraviolet transmissible barrier could be a wire mesh or glass.

Barrier 8B can be adapted to permit any type of radiation, such as infrared energy, to pass from the lamp 3 to the targeted work surface.

A plurality of blowers 5 can be provided on the inner surface of the support box 4A to supply an airflow through positioning panel 1. Air can enter the positioning panel 1 through air holes 8C in the cage frame 8A. In this case the air flows over the lamp 3 and provides a cooling effect. Air, can then be drawn into the support box 4 through air holes 2B located in the positioning panel body 2. It can be discharged by the blowers 5 venting away from the lamp 3 through the back of the support box 4 and positioning panel body 2. As a result, cool air can be drawn in and therefore does not disturb or deposit dust or particles on the work surface. The number, size and arrangement of both air holes 2A and 8C and blowers 5 can be varied as desired to suit the cooling requirements.

Figure 3:
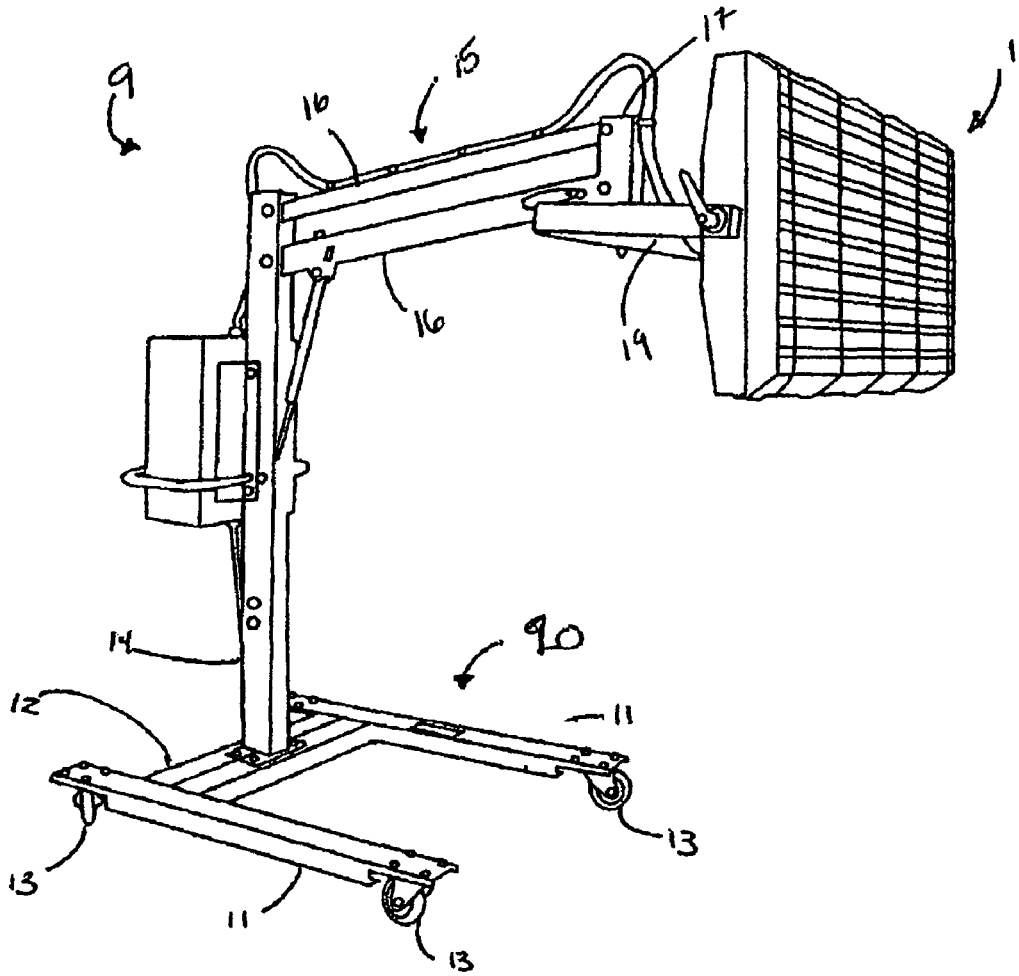
FIG. 3 provides a perspective view of one version of the curing apparatus showing the support stand and positioning panel.
Figure 4:
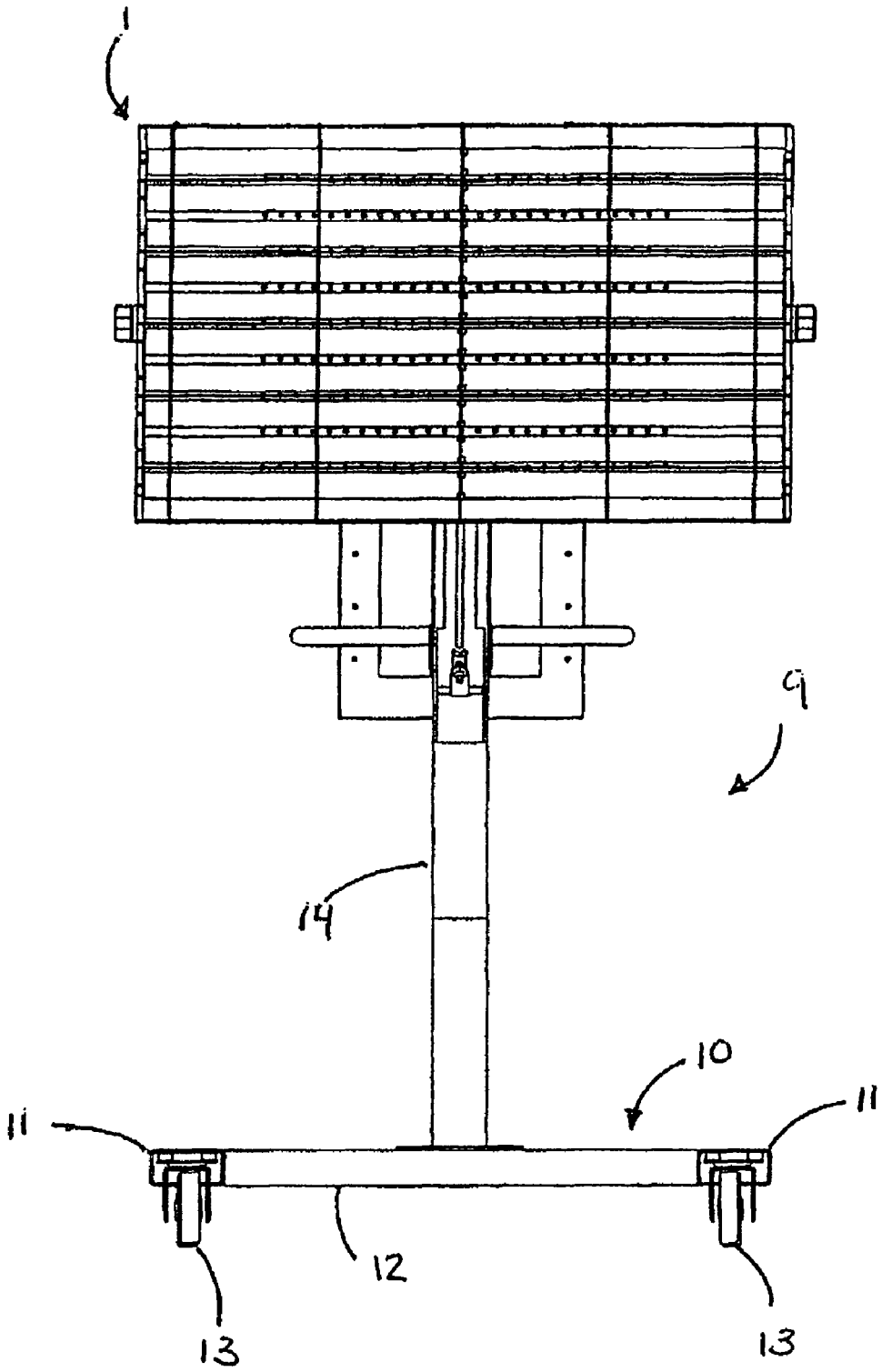
FIG. 4 provides a view of the front of the curing apparatus showing both a support stand and positioning panel.
Figure 5:
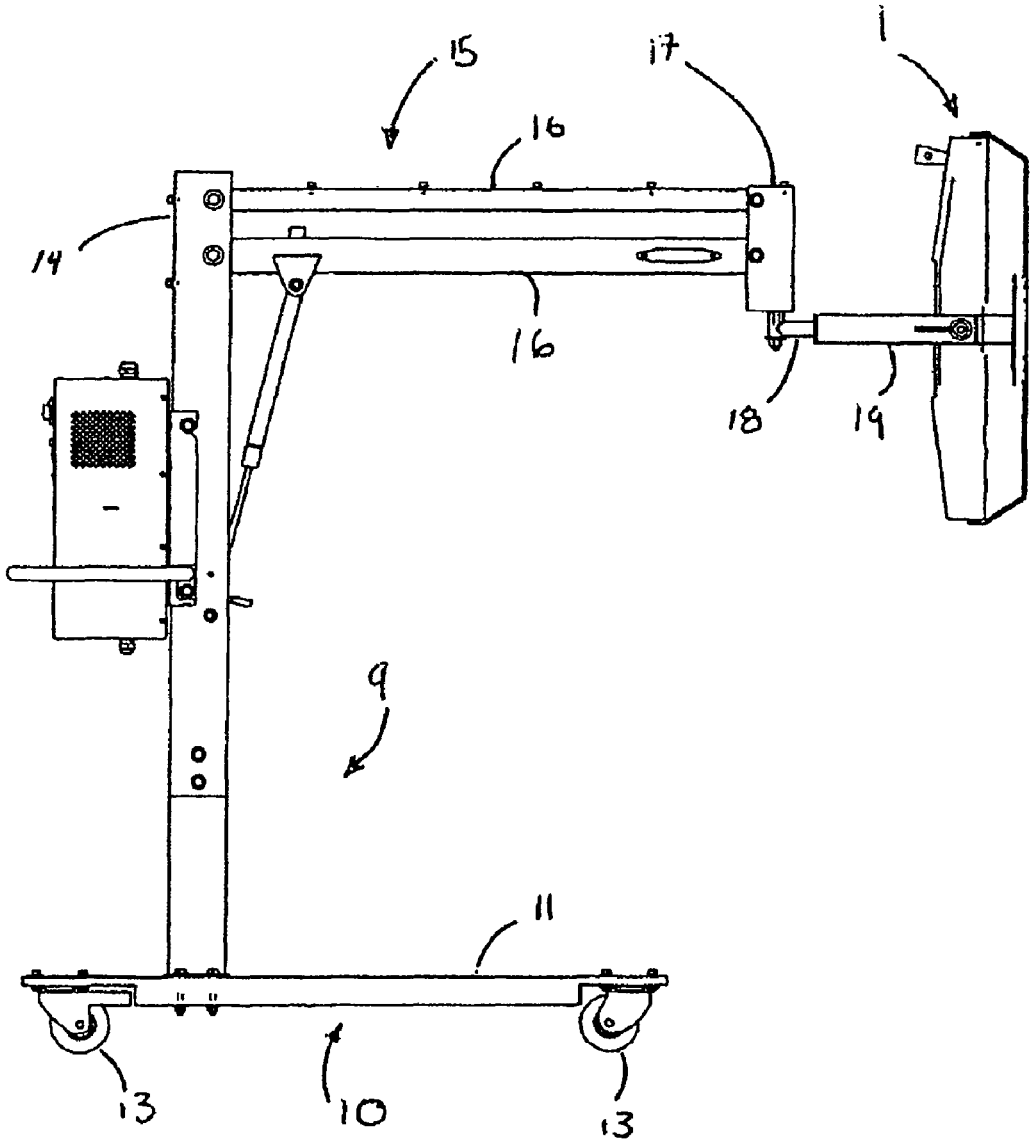
FIG. 5 provides a side of the curing apparatus showing both a support stand and positioning panel.

FIGS. 3-5 show embodiments of the curing apparatus including a support frame structure 9 for supporting positioning panel 1. Support frame 9 allows positioning panel 1 to be manipulated and maneuvered to the appropriate position for curing coatings on the work surface. Support frame 9 allows adjustments to the height, angle and distance of the positioning panel body 1 from the work surface.

In certain embodiments support frame 9 can be comprised of a structural base 10 containing two longitudinal members 11 joined by a transverse member 12. The transverse member is located between two longitudinal members 10 arranged in the form of the letter "H." Two longitudinal members 10 are provided with a plurality of casters 13 situated at various positions along the underside of the longitudinal members, allowing the support frame to be easily maneuvered.

Support base 9 includes a vertical support 14 extending from structural base 10 located in the middle of transverse member 12.

Positioning panel 1 can be coupled, by an adjustable arm assembly 15, to vertical support 14. Vertical support 14 can be used to position the positioning panel 1 in a suitable position for curing the targeted work surface. The adjustable arm assembly 15 extends between vertical support 14 and arm support bracket 17 and contains pivotal linkage connections at each end. The adjustable arm assembly 15 can have two parallel, equal length members 16 and the arm support bracket 17 creating a linkage that allows the positioning panel 1 to be infinitely positioned between a minimum and maximum vertical range. A pitman arm 18 can be attached to arm support bracket 17 creating a pivot rotation linkage, providing a means for angular positioning of positioning panel 1 relative to both the vertical axis and horizontal axis. A yoke 19 completes the linkage from pitman arm 18 to lamp head 1. Yoke 19 provides a method for rotation of positioning panel 1 with respect to the horizontal plane.

Figure 6:
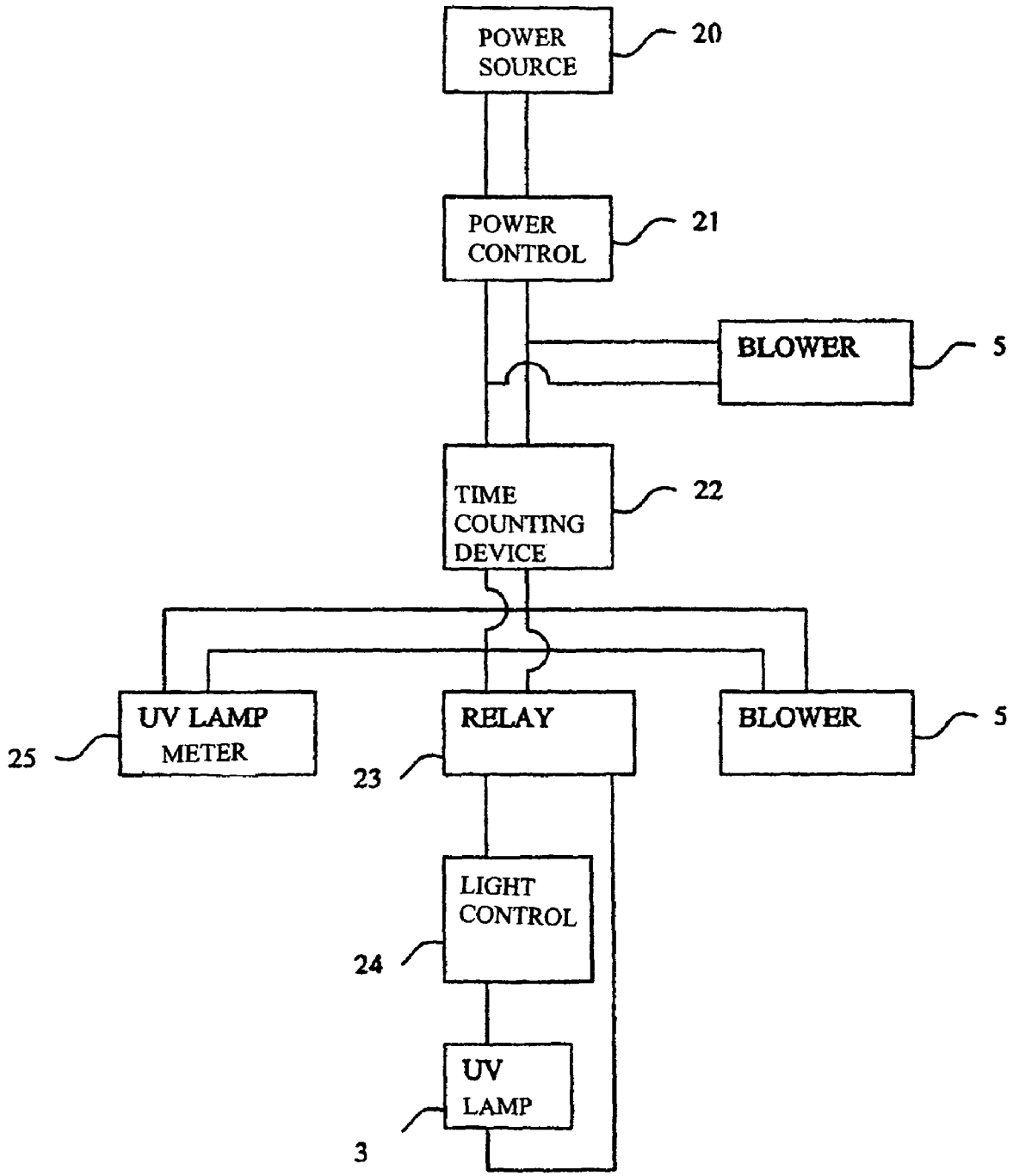
FIG. 6 provides a diagram showing various components that can be used in one configuration of the present invention.

FIG. 6 illustrates one suitable radiation control device of the present invention. The control device comprises a power source 20, power control device 21, a time counting device 22, and a lighting circuit. The lighting circuit is comprised of the lamp 3, light control devices 24 and a relay 23. The lighting circuit can be for ultraviolet lighting, infrared lighting, or both. The apparatus is equipped with a timing device 22 that will shut off electrical power the circuit once the set time has elapsed. Blowers 5 in positioning panel 1 can be powered at the same time as the light circuit, to create airflow with the lamp 3 when the lamp is operational. The lighting circuit can include additional devices such as an hour meter 25 to measure the duration of emitting radiation. Blower 5 can be connected to the power supply providing airflow through the apparatus for the control device. Further, the blower 5 can have variable speeds, depending upon the type of radiation emitted by the lamp 3 and the cooling necessitated in a particular application.

The efficiency made available by the present invention as described above for curing curable surface coating materials, provides an effective apparatus aiding in automobile panel repair.

EXAMPLE 1

This example demonstrates the operation of an apparatus of the present invention in curing a coating on a work surface using ultraviolet radiation and examines the distance dependence of curing and temperature measurements.

Employing the curing apparatus set forth in FIGS. 3-5, 4 sample plates of unpainted aluminium, measuring 200 mm in length, 100 mm in width and 1.3 mm in thickness, were arranged in a rectangular pattern on a flat surface, spaced 25 mm apart. The positioning panel 1 was positioned parallel to the work surface containing the samples at specific test distances of 100 mm, 200 mm and 300 mm. The positioning panel was centered on the samples in both lateral and longitudinal directions. The samples were irradiated for 2 min, the duration required to cure the ultraviolet surface coating materials. The ambient temperature was recorded for each sample before and after the irradiation cycle. Three trial runs were performed at each distance for each sample.

Upon measurement of the ambient temperature of each sample plate the following tests and 3 trial runs for each test was performed:

- Test number 1: 100 mm distance between samples and lamp head for a 2-minute exposure.
- Test number 2: 200 mm distance between samples and lamp head for a 2-minute exposure.
- Test number 3: 300 mm distance between samples and lamp head for a 2-minute exposure.

The testing shows that the temperature increase during the curing process is minimal in each case. This allows for repairs to continue immediately after curing, eliminating the need for a cooling cycle as require with other devices.

The test results from each of the three tests are shown below in Table 1.

TABLE 1

| | TRIAL RUN NO. 1 | | | TRIAL RUN NO. 2 | | | TRIAL RUN NO. 3 | | |
|---|---|---|---|---|---|---|---|---|---|
| SAMPLE NO. | START TEMP ° C. | FINISH TEMP ° C. | DIFFER-ENTIAL ° C. | START TEMP ° C. | FINISH TEMP ° C. | DIFFER-ENTIAL ° C. | START TEMP ° C. | FINISH TEMP ° C. | DIFFER-ENTIAL ° C. |
| TEST 1, 100 MM FROM SAMPLE SURFACE. 2 MINUTES EXPOSURE | | | | | | | | | |
| 1 | 22.1 | 25.3 | 3.2 | 22.9 | 26.3 | 3.4 | 22.5 | 25.8 | 3.3 |
| 2 | 22.3 | 25.0 | 2.7 | 22.9 | 26.0 | 3.1 | 22.6 | 25.8 | 3.2 |
| 3 | 22.1 | 25.4 | 3.3 | 23.0 | 25.9 | 2.9 | 22.6 | 25.7 | 3.1 |
| 4 | 22.0 | 25.5 | 3.5 | 23.0 | 26.1 | 3.1 | 22.7 | 25.9 | 3.2 |
| TEST 2, 200 MM FROM SAMPLE SURFACE. 2 MINUTES EXPOSURE | | | | | | | | | |
| 1 | 22.9 | 25.4 | 2.5 | 23.4 | 25.0 | 1.6 | 23.1 | 26.2 | 3.1 |
| 2 | 23.0 | 25.0 | 2.0 | 23.5 | 25.2 | 1.7 | 23.2 | 26.0 | 2.8 |
| 3 | 23.0 | 25.3 | 2.3 | 23.4 | 25.9 | 2.5 | 23.3 | 26.1 | 2.8 |
| 4 | 23.2 | 25.4 | 2.2 | 23.4 | 26.1 | 2.7 | 23.4 | 25.9 | 2.5 |
| TEST 3, 300 MM FROM SAMPLE SURFACE. 2 MINUTES EXPOSURE | | | | | | | | | |
| 1 | 23.8 | 25.6 | 1.8 | 23.4 | 25.6 | 2.2 | 23.6 | 24.9 | 1.3 |
| 2 | 23.7 | 25.5 | 1.8 | 23.6 | 25.7 | 2.1 | 23.5 | 25.2 | 1.7 |
| 3 | 23.8 | 25.4 | 1.6 | 23.4 | 25.4 | 2.0 | 23.5 | 25.3 | 1.8 |
| 4 | 23.9 | 25.4 | 1.5 | 23.6 | 25.4 | 1.8 | 23.4 | 25.2 | 1.8 |

Please recognize that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

What is claimed is:

1. An apparatus for curing a surface coating material comprising:

a radiation source adapted to cure a curable resin on a target curing surface, a cooling system that vents air away from a target curing surface by drawing air adjacent to the target curing surface through the cooling system and exhausting the air away from the target curing surface, and a positioning panel that supports the radiation source and cooling system and allows the radiation source to be rotated horizontally and vertically such that radiation can be accurately directed towards the target curing surface.

2. The apparatus for curing a surface coating material of claim 1, further comprising at least one ballast for powering the radiation source.

3. The apparatus for curing a surface coating material of claim 1, wherein the radiation source is an ultraviolet radiation source.

4. The apparatus for curing a surface coating material of claim 1, wherein the radiation source is an ultraviolet radiation source comprising a fluorescent bulb.

5. The apparatus for curing a surface coating material of claim 1, wherein the radiation source is an ultraviolet radiation source comprising a fluorescent bulb wherein the length of the fluorescent bulb is selected from the group of lengths consisting of about 19 inches, about 30 inches, about 34 inches, about 44 inches, about 46 inches, about 56 inches, about 70 inches, about 82 inches, about 94 inches, and any standard bulb length.

6. The apparatus for curing a surface coating material of claim 1, further comprising a ballast, wherein the radiation source is an ultraviolet radiation source comprising a fluorescent bulb and the power output of the ballast is greater than the power requirement of the fluorescent bulb.

7. The apparatus for curing a surface coating material of claim 1, further comprising an infrared light source.

8. The apparatus for curing a surface coating material of claim 1, wherein the cooling system comprises a fan.

9. The apparatus for curing a surface coating material of claim 1, wherein the cooling system comprises a variable speed fan.

10. The apparatus for curing a surface coating material of claim 1, wherein the cooling system comprises compressed air.

11. The apparatus for curing a surface coating material of claim 1, further comprising a temperature sensor adapted to detect temperature in or near the positioning panel.

12. The apparatus for curing a surface coating material of claim 1, further comprising a temperature sensor adapted to shut off the radiation source when the temperature exceeds a preset value.

13. The apparatus for curing a surface coating material of claim 1, wherein the radiation source comprises at least one light emitting diode.

14. The apparatus for curing a surface coating material of claim 1, wherein the radiation source comprises at least one laser.

15. The apparatus for curing a surface coating material of claim 1, wherein the positioning panel further comprises a reflector positioned such that radiation is reflected in the direction of the target curing surface.

16. The apparatus for curing a surface coating material of claim 1, wherein the apparatus further comprises a timer adapted to time a curing treatment.

17. The apparatus for curing a surface coating material of claim 1, wherein the apparatus further comprises a visual reference aid adapted to visually project a perimeter of the radiation upon the target curing surface in the positioning of the positioning panel.

18. The apparatus for curing a surface coating material of claim 1 wherein the apparatus further comprises a counter adapted to measure the operational life of the radiation source.

19. The apparatus for curing a surface coating material of claim 1, wherein the apparatus further comprises a radiometer adapted to measure the amount of ultraviolet radiation transmitted to a work surface.

20. The apparatus for curing a surface coating material of claim 1, wherein the apparatus further comprises a distance sensing device adapted to measure the distance of the positioning panel from the work surface.

21. The apparatus for curing a surface coating material of claim 1, wherein the apparatus further comprises a distance sensing device adapted to measure the distance of the positioning panel from the work surface and an alarm adapted to signal when the positioning panel is positioned at an inappropriate distance from the work surface.

* * * * *